US008368319B2

(12) United States Patent
Deurenberg

(10) Patent No.: US 8,368,319 B2
(45) Date of Patent: Feb. 5, 2013

(54) MULTI-CORE LIGHT ENGINE ARCHITECTURE

(75) Inventor: Peter H. F. Deurenberg, S-Hertogenbosch (NL)

(73) Assignee: NXP B.V., Eindhoven (NL)

( * ) Notice: Subject to any disclaimer, the term of this patent is extended or adjusted under 35 U.S.C. 154(b) by 212 days.

(21) Appl. No.: 12/866,445

(22) PCT Filed: Feb. 2, 2009

(86) PCT No.: PCT/IB2009/050415

§ 371 (c)(1), (2), (4) Date: Aug. 5, 2010

(87) PCT Pub. No.: WO2009/098633

PCT Pub. Date: Aug. 13, 2009

(65) Prior Publication Data

US 2010/0320941 A1 Dec. 23, 2010

(30) Foreign Application Priority Data

Feb. 7, 2008 (EP) ..... 08101378

(51) Int. Cl.
*H05B 37/02* (2006.01)

(52) U.S. Cl. ..... 315/291; 315/308

(58) Field of Classification Search ..... 315/149–159, 315/291, 307–308

See application file for complete search history.

(56) References Cited

U.S. PATENT DOCUMENTS

| | | | | |
|---|---|---|---|---|
| 6,495,964 | B1 * | 12/2002 | Muthu et al. | 315/149 |
| 6,608,453 | B2 * | 8/2003 | Morgan et al. | 315/312 |
| 7,315,139 | B1 * | 1/2008 | Selvan et al. | 315/291 |
| 2006/0176528 | A1 | 8/2006 | Dalrymple et al. | |
| 2007/0040512 | A1 * | 2/2007 | Jungwirth et al. | 315/159 |
| 2007/0273290 | A1 * | 11/2007 | Ashdown et al. | 315/113 |
| 2008/0203945 | A1 * | 8/2008 | Deurenberg et al. | 315/307 |
| 2009/0189530 | A1 * | 7/2009 | Ashdown et al. | 315/152 |
| 2009/0236994 | A1 * | 9/2009 | Deurenberg | 315/152 |
| 2010/0315007 | A1 * | 12/2010 | Schulz et al. | 315/152 |
| 2010/0327755 | A1 * | 12/2010 | Meijer et al. | 315/152 |

FOREIGN PATENT DOCUMENTS

| | | | |
|---|---|---|---|
| EP | 1229733 | A2 | 8/2002 |
| EP | 1 622 427 | A2 | 2/2006 |
| WO | 2007/033667 | A1 | 3/2007 |
| WO | 2007/052195 | A1 | 5/2007 |
| WO | 2007/072321 | A1 | 6/2007 |
| WO | 2007/141748 | A1 | 12/2007 |

* cited by examiner

*Primary Examiner* — Jason M Crawford

(57) ABSTRACT

The present invention relates to a LED lighting system (100) comprising at least a central controller (40) for just controlling a communication databus (50) in broadcast mode, and a distribution of LED controllers (30R, 30G, 30B) for individually controlling each LED (10R, 10G, 10B) through a respective driver (20R, 20G, 20B). The central controller (40) broadcasts targeted setting values from an external user (60) to all the distributed LED controllers (30R, 30G, 30B) through the databus (50). The LED controllers (30R, 30G, 30B) convert the values using a shared calibration matrix into transformed values for each LED color (R, G, B). In the case that some of these transformed values cannot be rendered by the LED lighting system (100), the targeted setting values can be properly adjusted either externally through a feedback signal sent over a link (70) back to the user (60), or internally through a notification signal broadcast over the databus (50) back to the central controller (40).

20 Claims, 4 Drawing Sheets

MULTI-CORE LIGHT ENGINE ARCHITECTURE

FIELD OF THE INVENTION

The present invention relates to the field of lighting devices, and more particularly to a LED lighting system with a distribution of LED controllers.

BACKGROUND OF THE INVENTION

Luminaires based on red, green, and blue (RGB) light-emitting diodes (LEDs) generate various colors of light, which produce white or colored light when properly combined. RGB LED luminaires are used, for example, in LCD back-lighting, commercial-freezer lighting, and white light illumination.

Usually, for these multi-color LED-based luminaires, the controller of the light engine receives from a user or a higher level system, e.g. a building management system, the desired or targeted color point and light level. These setting values can be specified with tristimulus values in CIE x, y, L representing a certain position in the CIE 1931 chromaticity diagram created by the Commission Internationale de l'Eclairage (CIE), and thus need to be transformed into duty cycles or power levels for each connected LED color. Then, the transformation can be individually performed by a distribution of LED controllers through a calibration matrix (inverted C-matrix) shared between all of them.

However, illumination by means of such LED-based luminaires presents difficulties because the optical and electrical properties of individual LEDs vary with temperature, forward current, aging and manufacturing process. In particular, change in temperature of the LED p-n junction leads to changes in light flux output and peak wavelength of the LED, such that the calculations through the calibration matrix are also temperature dependent.

Additionally, it can be possible that no entity inside the light engine has a gamut knowledge. Under these circumstances, these variations can hence lead to abnormal situations for which the light engine cannot render the targeted color point and light level externally input by the user or the higher level system. Examples of such abnormal situations can be non-existing color points, e.g. (0,1), (1,0), (0.05,0.1), or color points outside the color gamut of the light engine due for example to multiple luminaires connected to the same communication databus controlled by the light engine, requiring thereby negative power levels for some LED colors, or light levels at a color point beyond the capabilities of the light engine, requiring thereby power levels beyond the capabilities of the corresponding LED colors.

In normal situations, each LED controller can perform the aforementioned calculations independently of the other since a single row of the calibration matrix is needed. However, in abnormal situations such as described herein, the LED controllers are required to communicate between them through the parameters of the calibration matrix to achieve a logical behavior. But this is not always possible according to the architecture of the light engine.

SUMMARY OF THE INVENTION

It is therefore an object of the present invention to provide for a multi-core LED lighting system architecture enabling logical behavior for invalid or out-of-range target settings.

This object is achieved by a lighting system as claimed in claim 1, a method of adjusting internally a out-of-gamut targeted value as claimed in claim 19, a method of adjusting internally a out-of-range targeted value as claimed in claim 9, a method of adjusting externally, e.g. through an external user or a higher level system, a out-of-gamut and/or out-of-range targeted value as claimed in claim 16, and a method of adjusting internally and externally a out-of-gamut and/or out-of-range targeted value as claimed in claim 14.

In accordance with the present invention, there is provided a lighting system comprising: at least one light emitting diode (LED); a communication databus; a controller for controlling the communication databus in broadcast mode; a plurality of control units for individually controlling each of the at least one LED, each control unit being in data communication with the controller via the databus; wherein, the controller is input by at least one targeted value from a user and broadcasts, via the databus, the at least one targeted value towards the plurality of control units; at least one amongst the plurality of control units has an incapacity to comply with the at least one targeted value, and each of the at least one amongst the plurality of control units transmits a signal for notifying upon the incapacity; the controller broadcasts, via the databus, an adjusted value with respect to the at least one targeted value towards the plurality of control units.

Thereby, the solution as an adjusted value can be communicated to all the control units thanks to the databus in broadcast mode, such that the lighting system can ensure a logical behavior when handling target values it cannot render.

In the following, advantageous embodiments will be described, which are also defined in the dependent claims. The embodiments can be combined with each other, unless explicitly stated otherwise.

The adjusted value may be a value adjusted by the controller in response to the signal transmitted by each of the at least one amongst the plurality of control units towards the controller. Thereby, the controller is notified upon the incapacity of at least one control unit to comply with the at least one targeted value.

The adjusted value may be a value desaturated with respect to the at least one targeted value, and in particular a desaturated color point, such that the at least one targeted value may be considered by the lighting system as a out-of-gamut color point.

The adjusted value may be a value selected by the controller amongst the values adjusted by each of the at least one amongst the plurality of control units, the signal being transmitted towards the controller and further comprising the values adjusted by each of the at least one amongst the plurality of control units. Thereby, the controller is notified upon the incapacity of at least one control unit to comply with the at least one targeted value, and also upon the solutions as adjusted values proposed by each of the at least one control unit to comply with the at least one targeted value. Through the selection, a single adjusted value is selected, and the desaturated value is prioritized over the selected value.

Each of the values adjusted by each of the at least one amongst the plurality of control units may be a value reduced with respect to the at least one targeted value. Thereby, the selected adjusted value will be a value reduced with respect to the at least one targeted value.

The adjusted value selected by the controller may be the lowest value amongst the values adjusted by each of the at least one amongst the plurality of control units. Thereby, all the control units will comply with the adjusted value broadcast to all of them by the controller over the databus.

In particular, the adjusted value may be a reduced light level at the color point with respect to the at least one targeted value, such that the at least one targeted value may be considered by the lighting system as a out-of-range light level at the color point.

The adjusted value broadcast by the controller may be originated from the user. In a first aspect, the value may be adjusted by the user in response to the signal transmitted by each of the at least one amongst the plurality of control units towards the user. Thereby, the at least one targeted value may be externally adjusted, in response to the notification upon the incapacity of at least one control unit to comply with the at least one targeted value, received by the user. In a second aspect, the value may already be adjusted. For example, it may be the value selected by the controller, the value directly adjusted by the controller, the value adjusted by the control unit if alone to be not in compliance with the at least one targeted value, or a combination between them. The user is thus not only notified upon the incapacity of at least one control unit to comply with the at least one targeted value, but also notified upon the solution.

The signal transmitted by the at least one control unit unable to comply with the at least one targeted value towards the controller may be carried out via the bus, namely internally.

The signal transmitted by the at least one control unit unable to comply with the at least one targeted value towards the user is carried out via a feedback link, namely externally.

The at least one targeted value may be transformed through a calibration matrix into a duty cycle for each color emitted by the at least LED. Thereby, the calibration matrix is shared by all of the control units, such that a communication between them is required in the case that the targeted value cannot be rendered by the lighting system.

In accordance with the present invention and derived from which precedes, there are also provided a method of adjusting internally a out-of-gamut targeted value, a method of adjusting internally a out-of-range targeted value, a method of adjusting externally, e.g. through an external user or a higher level system, a out-of-gamut and/or out-of-range targeted value, and a method of adjusting internally and externally a out-of-gamut and/or out-of-range targeted value.

The steps of the previous methods can be carried out by a computer program including program code means, when the computer program is carried out on a computer.

These and other features and advantages of the present invention will be apparent from the figures as fully explained in the detailed description of embodiments of the invention.

BRIEF DESCRIPTION OF THE DRAWINGS

These and other aspects of the invention will be apparent from and elucidated with reference to the embodiment(s) described hereinafter. In the following drawings.

DETAILED DESCRIPTION OF EMBODIMENTS

Figure 1:
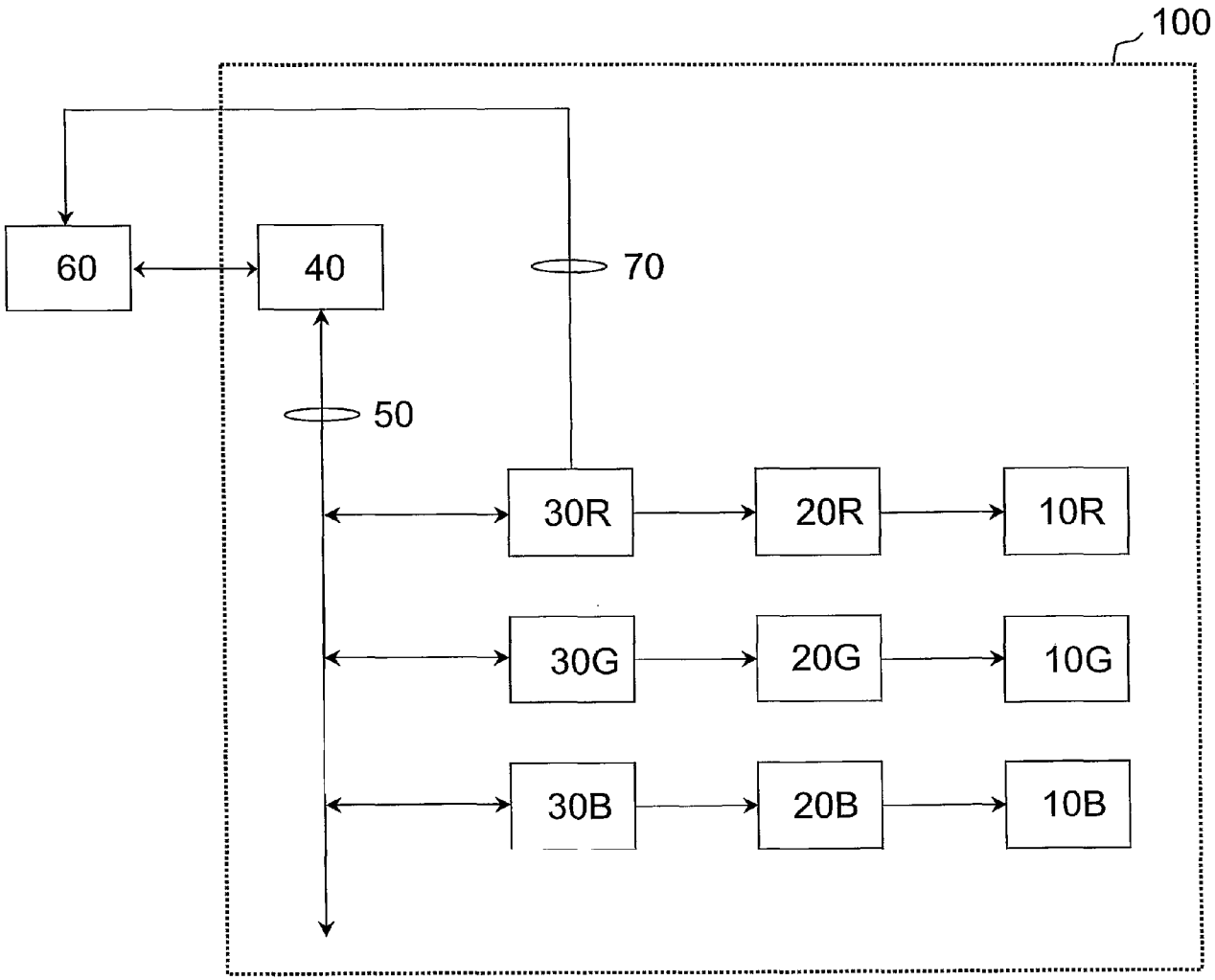
FIG. 1 shows a block diagram of a LED lighting system 100 according to an exemplary embodiment of the present invention, in the case that the LED controller 30R is unable to comply with the targeted setting values.

FIG. 1 is a block diagram of a LED lighting system 100 according to an exemplary embodiment of the present invention, in the case that the LED controller 30R is unable to comply with the targeted setting values. The LED lighting system 100 can produce white light or colored light by mixing in an appropriate way the output of the different LEDs 10R, 10G, 10B, and it can be used for illumination or lighting purposes.

The LED lighting system 100, e.g. a light engine, is a multi-core architecture comprising a light bar of at least one light emitting diode (LED) 10R, 10G, 10B, typically three LEDs of different primary colors: red R, green G and blue B. Each LED 10R, 10G, 10B is connected to a respective driver 20R, 20G, 20B for allowing current to flow through each of them. The drivers 20R, 20G, 20B are individually controlled by a distribution of respective LED controllers 30R, 30G, 30B, i.e. control units.

The LED lighting system 100 further comprises a central controller 40 and a communication databus 50. The targeted setting values, e.g. a color point and/or a light level, are externally input by a user 60 or a higher level system, e.g. a building management system, to the central controller 40, which then broadcasts the targeted setting values over the databus 50 to all the LED controllers 30R, 30G, 30B.

The targeted setting values are specified with tristimulus values in CIE x, y, L representing a certain position in the CIE 1931 chromaticity diagram. The LED controllers 30R, 30G, 30B individually carry out some calculations for allowing the targeted setting values to be transformed, through a shared calibration matrix (inverted C-matrix), into a duty cycle or power level for each LED color R, G, B.

Figure 2:
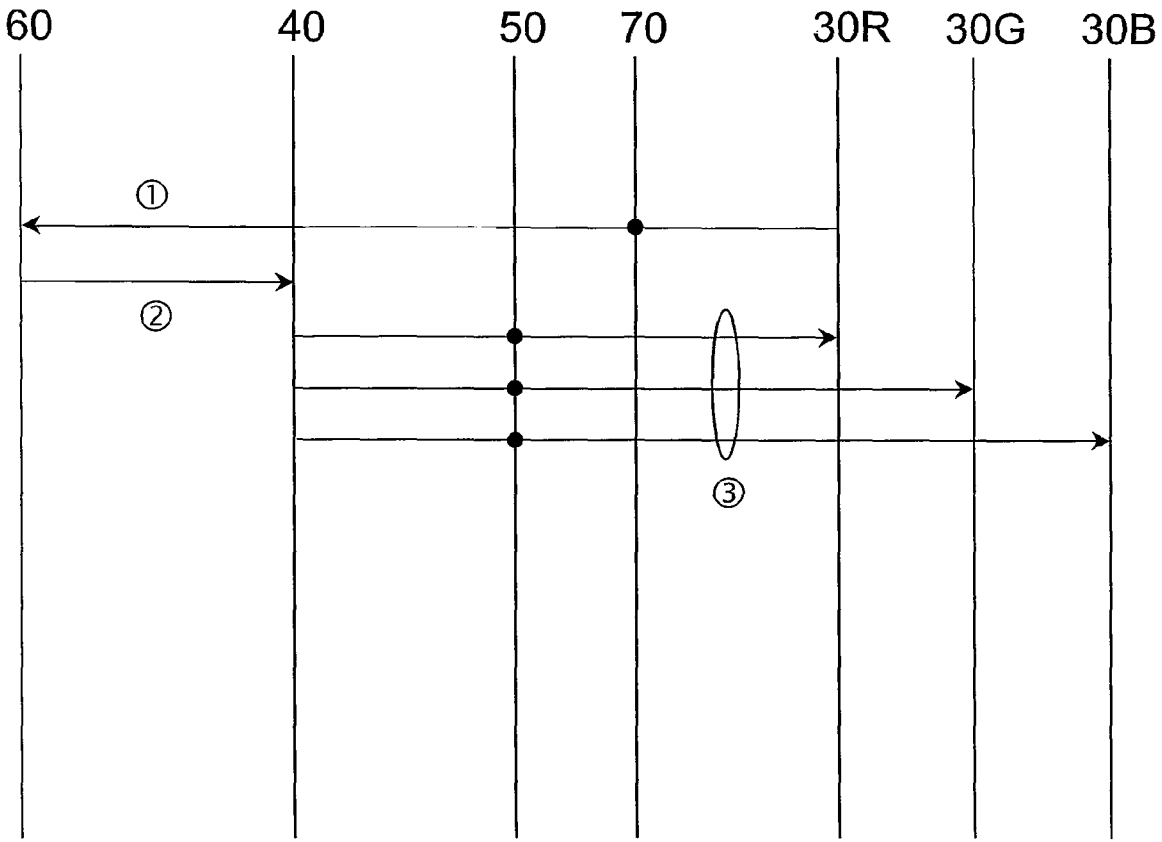
FIG. 2 shows a schematic flow diagram of a transmission link according to a first and fourth exemplary embodiment of the present invention, in the case that the LED controller 30R of FIG. 1 is unable to comply with the targeted setting values.

FIG. 2 depicts a schematic flow diagram of a transmission link according to a first exemplary embodiment of the present invention, in the case that the LED controller 30R of FIG. 1 is unable to comply with the targeted setting values. In this first embodiment wherein the broadcast targeted setting values are invalid or out-of-gamut color points and/or out-of-range light levels at a color point, each of the LED controllers 30R, 30G, 30B that is unable to comply with these values, e.g. the LED controller 30R as illustrated in FIGS. 1 and 2, sends a feedback signal over a link 70 back to the external user 60 or a higher level system, in order to inform them about this abnormal situation (arrow 1). Based on this information, the user 60 or the higher level system can decide on new targeted setting values, i.e. adjusted values, submitted to the central controller 40 (arrow 2), which then broadcasts them over the databus 50 to all the LED controllers 30R, 30G, 30B (arrow 3). The process repeats until the targeted setting values can be rendered by the LED lighting system 100. The adjusted values may be either reduced values if the broadcast targeted setting values are out-of-range light levels or desaturated values if the broadcast targeted setting values are out-of-gamut color points.

Figure 3:
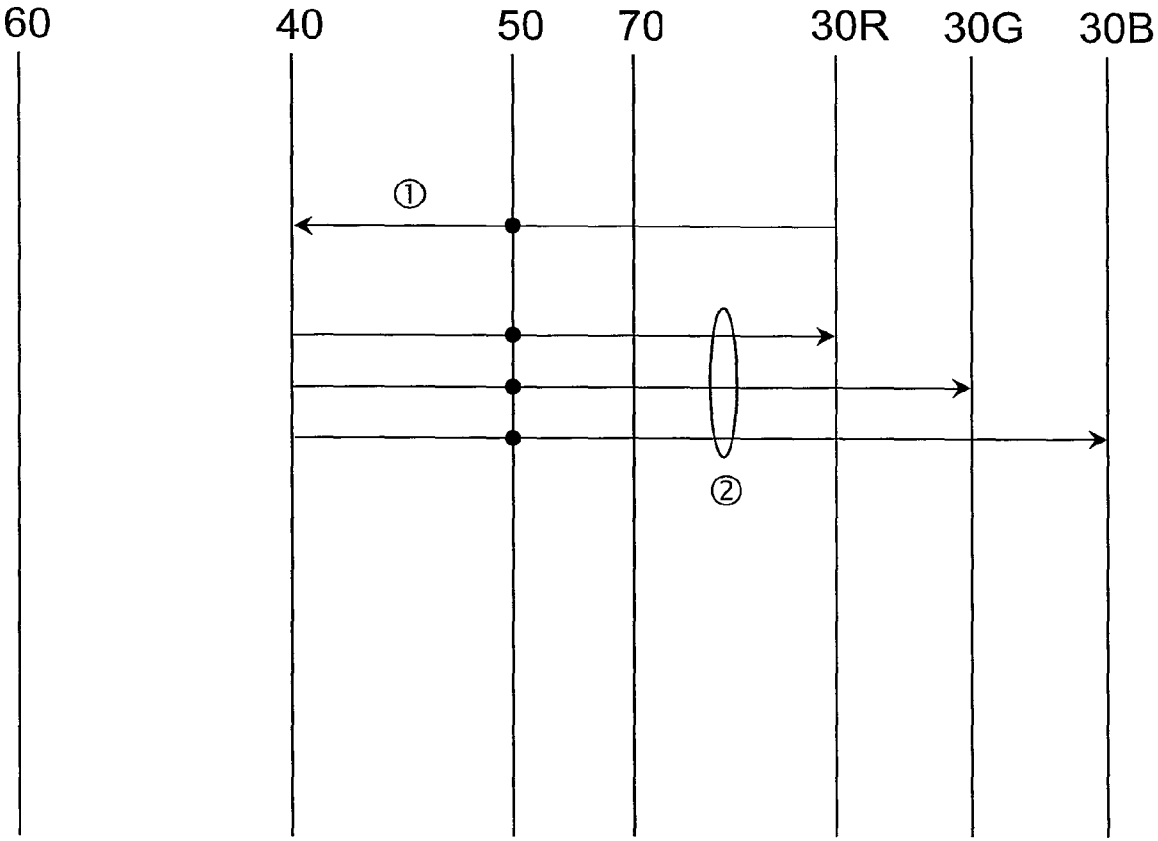
FIG. 3 shows a schematic flow diagram of a transmission link according to a second and third exemplary embodiment of the present invention, in the case that the LED controller 30R of FIG. 1 is unable to comply with the targeted setting values.

FIG. 3 depicts a schematic flow diagram of a transmission link according to a second exemplary embodiment of the present invention, in the case that the LED controller 30R of FIG. 1 is unable to comply with the targeted setting values. In this second embodiment wherein the broadcast targeted setting values are out-of-gamut color points, each of the LED controllers 30R, 30G, 30B that is unable to comply with these values, e.g. the LED controller 30R as illustrated in FIGS. 1 and 3, sends a signal over the databus 50 back to the internal central controller 40, in order to notify it upon this abnormal situation (arrow 1). In response to this notification, the central controller 40 can then decide to desaturate the color while rendering the color closest to the targeted color point. The new targeted setting values, i.e. the newly adjusted color point with the targeted light level, are afterwards broadcast over the databus 50 directly by the central controller 40 to all the LED controllers 30R, 30G, 30B (arrow 2). The process repeats until the targeted setting values can be rendered by the LED lighting system 100.

FIG. 3 also depicts a schematic flow diagram of a transmission link according to a third exemplary embodiment of the present invention, in the case that the LED controller 30R of FIG. 1 is unable to comply with the targeted setting values. In this third embodiment wherein the broadcast targeted setting values are out-of-range light levels at a color point, each of the LED controllers 30R, 30G, 30B that is unable to comply with these values, e.g. the LED controller 30R as illustrated in FIGS. 1 and 3, sends a signal over the databus 50 from each of the LED controllers 30R, 30G, 30B that are unable to comply with these values, e.g. the LED controller 30R as illustrated in FIGS. 1 and 3, back to the internal central controller 40, in order to notify it upon this abnormal situation and also to propose it a new targeted light level at the color point that each can support, i.e. a reduced light level (arrow 1). The central controller 40 then broadcasts over the databus 50 the new targeted setting values, i.e. the newly adjusted light level at the color point, to all the LED controllers 30R, 30G, 30B (arrow 2). The process repeats until the targeted setting values can be rendered by the LED lighting system 100.

Furthermore, if several LED controllers 30R, 30G, 30B are unable to comply with the targeted setting values, the central controller 40, in response to the signals sent by each of these LED controllers 30R, 30G, 30Bs, selects the lowest light level at the color point amongst the light levels sent by these signals, and broadcasts over the databus 50 the color point with the newly adjusted light level to all the LED controllers 30R, 30G, 30B. Again, the process repeats until the targeted setting values can be rendered by the LED lighting system 100.

Thus, through this selection, it is to be noted that the targeted color point is prioritized over the targeted light level, and this matches with the eye sensitivity to color point differences higher than the eye sensitivity to the light level differences. It is furthermore to be noted that every entity in the LED lighting system 100 still deals with the color point information of a single color.

FIG. 2 also depicts a schematic flow diagram of a transmission link according to a fourth exemplary embodiment of the present invention, in the case that the LED controller 30R of FIG. 1 is unable to comply with the targeted setting values and the broadcast targeted setting values are out-of-range light levels at a color point. In this fourth embodiment that combines the previous solutions, the LED controller 30R sends a feedback signal over the link 70, as illustrated in FIGS. 1 and 2, back to the external user 60 or a higher level system, in order to notify them upon this abnormal situation and also to propose them a reduced light level as a solution (arrow 1). The user 60 or the higher level system can then decide either to submit these new targeted setting values to the central controller 40 (arrow 2), which then broadcasts them over the databus 50 to all the LED controllers 30R, 30G, 30B (arrow 3), or to submit other values (arrow 2). The process repeats until the targeted setting values can be rendered by the LED lighting system 100.

Furthermore, if several LED controllers 30R, 30G, 30B are unable to comply with the targeted setting values, the central controller 40 communicates after selection the solution, i.e. the lowest light level at the color point amongst the light levels sent by each of these LED controllers 30R, 30G, 30B, towards the external user 60 or the higher level system. The user 60 or the higher level system can then decide either to submit these new targeted setting values back to the central controller 40, which then broadcasts them over the databus 50 to all the LED controllers 30R, 30G, 30B, or to submit other values. The process repeats until the targeted setting values can be rendered by the LED lighting system 100.

Figure 4:
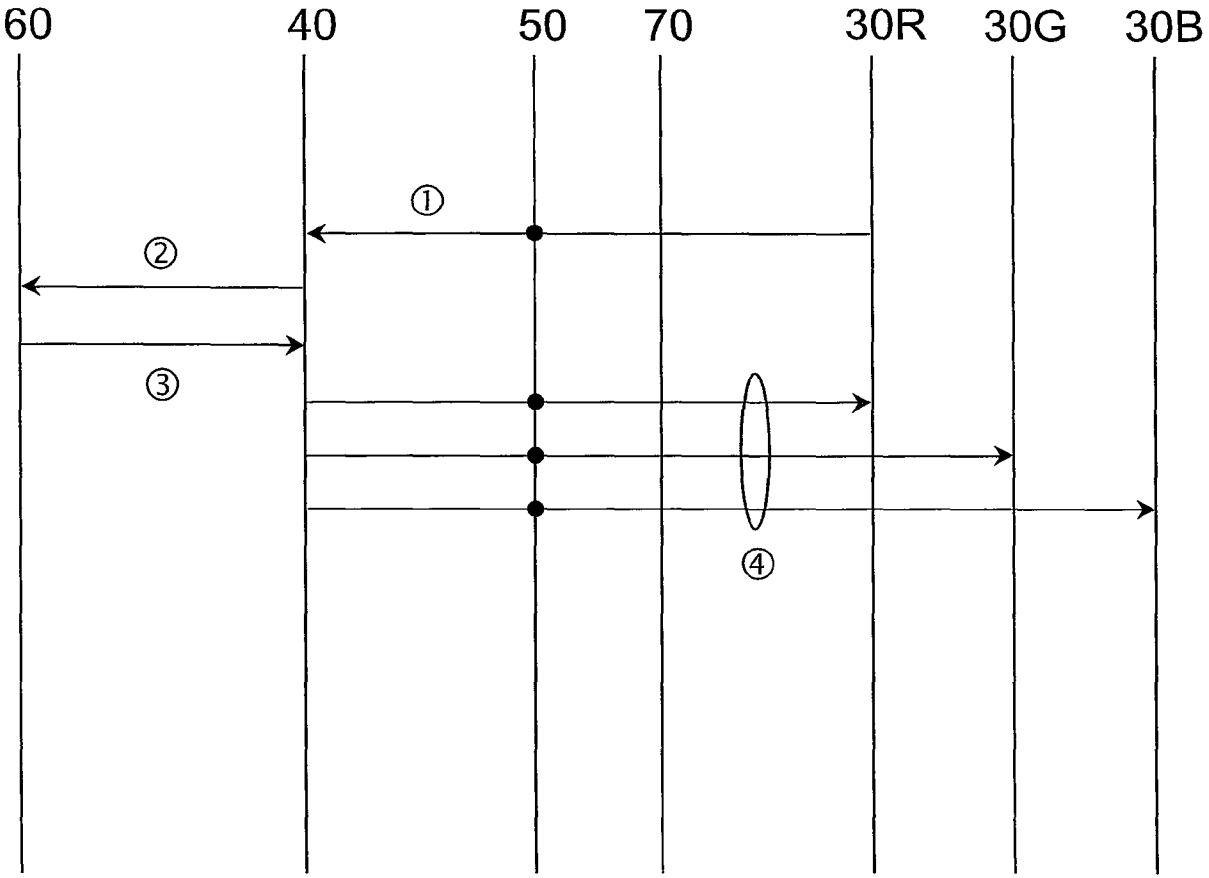
FIG. 4 shows a schematic flow diagram of a transmission link according to a fifth exemplary embodiment of the present invention, in the case that the LED controller 30R of FIG. 1 is unable to comply with the targeted setting values.

FIG. 4 depicts a schematic flow diagram of a transmission link according to a fifth exemplary embodiment of the present invention, in the case that the LED controller 30R of FIG. 1 is unable to comply with the targeted setting values and the broadcast targeted setting values are out-of-gamut color points. In this fifth embodiment that combines the previous solutions, the LED controller 30R sends a signal over the databus 50, as illustrated in FIGS. 1 and 4, back to the internal central controller 40, in order to notify it upon this abnormal situation (arrow 1). In response to this notification, the central controller 40 can then decide to desaturate the color while rendering the color closest to the targeted color point. Afterwards, the central controller 40 communicates, as solution, the new targeted setting values, i.e. the newly adjusted color point with the targeted light level, towards the external user 60 or the higher level system (arrow 2). The user 60 or the higher level system can then decide either to submit these new targeted setting values back to the central controller 40 (arrow 3), which then broadcasts them over the databus 50 to all the LED controllers 30R, 30G, 30B (arrow 4), or to submit other values (arrow 3). The process repeats until the targeted setting values can be rendered by the LED lighting system 100.

Thus, despite the fact that the central controller 40 can be considered as a "dumb" controller, which just controls the databus 50 in broadcast mode, and the fact that no entity (central controller 40, databus 50, LED controllers 30R, 30G, 30B, etc.) inside the LED lighting system 100 has a gamut knowledge, the present invention shows that it is possible of handling the targeted setting values wherein the color point and/or light level is invalid or out-of-range. This can be achieved by using "internal intelligence" of the LED lighting system 100 provided by the LED controllers 30R, 30G, 30B, and/or "external intelligence" provided by the user 60 or a higher level system, as well as the databus 50 in broadcast mode for enabling the communication with all the LED controllers 30R, 30G, 30B, and thus obtaining a logical behavior of the LED lighting system 100 under these circumstances.

In summary, a LED lighting system 100, comprising at least a central controller 40 for just controlling a communication databus 50 in broadcast mode, and a distribution of LED controllers 30R, 30G, 30B for individually controlling each LED 10R, 10G, 10B through a respective driver 20R, 20G, 20B, has been described. The central controller 40 broadcasts targeted setting values from an external user 60 to all the distributed LED controllers 30R, 30G, 30B through the databus 50. The LED controllers 30R, 30G, 30B convert the values using a shared calibration matrix into transformed values for each LED color R, G, B. In the case that some of these transformed values cannot be rendered by the LED lighting system 100, the targeted setting values can be properly adjusted either externally through a feedback signal sent over a link 70 back to the user 60, or internally through a notification signal broadcast over the databus 50 back to the central controller 40.

While the invention has been illustrated and described in detail in the drawings and foregoing description, such illustration and description are to be considered illustrative or exemplary and not restrictive; the invention is not limited to the disclosed embodiments. Thus, it is noted that the invention applies to any LED controllers, taken singly or combined between them, which are unable to comply with the targeted setting values.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single . . . or other unit may fulfill the functions of several items recited in the claims. The mere fact that certain measures are recited in mutually different dependent claims does not indicate that a combination of these measured cannot be used to advantage.

A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. A lighting system comprising:

at least one light emitting diode (LED);

a communication databus;

a controller for controlling said communication databus in broadcast mode;

a plurality of control units for individually controlling each of said at least one LED, each control unit being in data communication with said controller via said databus; wherein, said controller is input by at least one targeted value from a user and broadcasts, via said databus, said at least one targeted value towards said plurality of control units;

at least one amongst said plurality of control units has an incapacity to comply with said at least one targeted value, and each of said at least one amongst said plurality of control units transmits a signal for notifying upon said incapacity to said controller through said databus;

said controller broadcasts, via said databus, an adjusted value with respect to said at least one targeted value towards said plurality of control units.

2. The lighting system according to claim 1, wherein said adjusted value is a value adjusted by said controller in response to said signal transmitted by each of said at least one amongst said plurality of control units towards said controller.

3. The lighting system according to claim 2, wherein said adjusted value is a value desaturated with respect to said at least one targeted value.

4. The lighting system according to claim 2, wherein said at least one targeted value is a color point.

5. The lighting system according to claim 1, wherein said adjusted value is a value selected by said controller amongst the values adjusted by each of said at least one amongst said plurality of control units, said signal being transmitted towards said controller and further comprising said values adjusted by each of said at least one amongst said plurality of control units.

6. The lighting system according to claim 5, wherein each of said values adjusted by each of said at least one amongst said plurality of control units is a value reduced with respect to said at least one targeted value.

7. The lighting system according to claim 5, wherein said adjusted value selected by said controller is the lowest value amongst said values adjusted by each of said at least one amongst said plurality of control units.

8. The lighting system according to claim 5, wherein said at least one targeted value is a light level at a color point.

9. A method of adjusting an out-of-range targeted value in a lighting system according to claim 5, comprising:

notifying the controller upon said out-of-range targeted value;

reducing said out-of-range targeted value at the at least one amongst the plurality of control units that has an incapacity to comply with said out-of-range targeted value;

sending each of the reduced out-of-range targeted values towards said controller;

selecting the lowest value amongst each of said reduced out-of-range targeted values;

broadcasting said lowest value over the databus from said controller (40) towards said plurality of control units.

10. The method according to claim 9, wherein said out-of-range targeted value is a light level at a color point.

11. The lighting system according to claim 1, wherein said adjusted value broadcast by said controller is originated from said user.

12. The lighting system according to claim 11, wherein said adjusted value broadcast by said controller is a value adjusted by said user in response to said signal transmitted by each of said at least one amongst said plurality of control units towards said user.

13. The lighting system according to claim 11, wherein said adjusted value broadcast by said controller is a value adjusted by said controller and/or by one control unit if only one amongst said plurality of control units has an incapacity to comply with said at least one targeted value.

14. A method of adjusting an out-of-gamut and/or out-of-range targeted value in a lighting system according to claim 13, comprising:

adjusting said out-of-gamut and/or out-of-range targeted value at the controller or at the at least one amongst the plurality of control units;

notifying the user upon said out-of-gamut and/or out-of-range targeted value and upon said adjusted value;

transmitting a new targeted value or said adjusted value from said user towards said controller;

broadcasting said new targeted value or said adjusted value over the databus from said controller towards said plurality of control units.

15. The lighting system according to claim 11, wherein said signal is transmitted via a feedback link.

16. A method of adjusting an out-of-gamut and/or out-of-range targeted value in a lighting system according to claim 11, comprising:

notifying the user upon said out-of-gamut and/or out-of-range targeted value using the signal;

adjusting said out-of-gamut and/or out-of-range targeted value at said user;

sending said adjusted value towards the controller;

broadcasting said adjusted value over the databus from said controller towards the plurality of control units.

17. The method according to claim 16, wherein the adjusting step comprises reducing said out-of-range targeted value into a reduced value, and desaturating said out-of-gamut targeted value into a desaturated value.

18. The lighting system according to claim 1, wherein said at least one targeted value is transformed through a calibration matrix into a duty cycle for each color emitted by said at least LED.

19. A method of adjusting an out-of-gamut targeted value in a lighting system according to claim 1, comprising:

notifying the controller upon said out-of-gamut targeted value;

desaturating said out-of-gamut targeted value at said controller in response to the step of notifying;

broadcasting the desaturated out-of-gamut targeted value over the databus from said controller towards the plurality of control units.

20. The method according to claim 19, wherein said out-of-gamut targeted value is a color point.

* * * * *